United States Patent [19]

Lemmer et al.

[11] 4,401,863

[45] Aug. 30, 1983

[54] CONTACT DEVICE FOR LOW VOLTAGE SWITCH DEVICES

[75] Inventors: Helmut Lemmer; Kurt Breidenbach, both of Marienheide, Fed. Rep. of Germany

[73] Assignee: Starkstrom Gummersbach GmbH, Marienheide, Fed. Rep. of Germany

[21] Appl. No.: 292,826

[22] Filed: Aug. 14, 1981

[30] Foreign Application Priority Data

Sep. 6, 1980 [DE] Fed. Rep. of Germany ..... 3033668

[51] Int. Cl.[3] ..... H01H 9/30; H01H 15/00; H01H 1/00

[52] U.S. Cl. ..... 200/16 A; 200/144 R; 200/243; 335/196; 335/201; 335/202

[58] Field of Search ..... 200/16 A, 144 R, 241-247, 200/275; 335/196, 201, 202

[56] References Cited

U.S. PATENT DOCUMENTS

| | | | |
|---|---|---|---|
| 2,472,333 | 6/1949 | Kohl | 200/16 A X |
| 2,773,950 | 12/1956 | Bauer | 200/16 A X |
| 2,933,577 | 4/1960 | Wintle et al. | 200/16 A |
| 3,004,127 | 10/1961 | Carding et al. | 200/16 A X |
| 3,166,645 | 1/1965 | Shlesinger, Jr. | 200/16 A |
| 3,436,697 | 4/1969 | Snyder | 200/16 A X |

FOREIGN PATENT DOCUMENTS

| | | |
|---|---|---|
| 247323 | 11/1947 | Switzerland . |
| 451288 | 5/1968 | Switzerland . |

*Primary Examiner*—J. R. Scott

*Attorney, Agent, or Firm*—Allison C. Collard; Thomas M. Galgano

[57] ABSTRACT

A contact device for low voltage switch devices, includes at least two stationary contact bars with contact pieces, as well as at least one electrically-conductive contact bridge which is disposed in a contact bridge support and is movable by means of a spring force. In order to provide a good contact device wherein a weight and material saving is obtained, wherein simultaneously a switch-on impact of the contact is prevented and wherein a good adaptability of the movable contact pieces to the position of the stationary contact pieces is obtained, the contact bridge is made from a flexible material and a contact pressure spring for each of the two movable contact pieces is provided.

29 Claims, 9 Drawing Figures

CONTACT DEVICE FOR LOW VOLTAGE SWITCH DEVICES

BACKGROUND OF THE INVENTION

1. Field of the Invention

The invention relates to a contact device for low voltage switch devices. More particularly, it relates to contactors with at least two stationary contact bars having contact pieces, as well as at least one electrically-conductive contact bridge which is disposed in a contact bridge support and is movable by means of a spring force.

2. Description of the Prior Art

Contact devices of the aforementioned type are known, for example, from DE-AS 25 25 467, CH-PS 247 323 and CH-PS 451 288. In these contact devices, the contact bridges consist of massive bars engaged at the center thereof by of a single contact spring. It has been attempted by means of numerous structural measures to overcome the problem of burn-off of the contact pieces, for example, by pivot movements of the massive contact bridge with the movable contact pieces, or by roll motions of the movable contact pieces on the stationary contact pieces. However, a common disadvantage of all of these known contact devices is the combined effect of the relatively large movable mass of the contact bridge with the movable contact pieces. This mass is required for this type of structure, because the contact bridge in the form of a massive bar must be so designed that the required contact pressure forces are sufficiently transferred from the contact pressure spring. This results, on the one hand, in a large mass of material and, on the other hand, in a switch-on impact which, in actual practice, cannot be prevented. In order to keep these disadvantages to a minimum, it has been attempted to keep the contact bridges as short as possible. However, this results in other problems, for example, construction difficulties, insufficient switch safety, poor accessibility to all individual parts, and the like.

SUMMARY OF THE INVENTION

It is therefore an object of the invention to provide an improved contact device, wherein a weight and material saving is obtained, wherein simultaneously a switch-on impact of the contacts is prevented, and wherein an improved adaptability of the movable contact pieces to the position of the stationary contact pieces is obtained.

This object is obtained in accordance with the invention in that the contact bridge consists of a flexible material and that, for each of the contact pieces of the contact bridge, a contact pressure spring is provided.

In this manner, a weight reduction of about half or more, compared to the commonly known massive movable contact bridges, can be obtained. Due to the lower weight, there exists the possibility of making the flexible connection between the two contact pieces relatively long, so that unusually wider distances may be bridged. If need be, one could switch the stationary contacts crosswise if a plurality of stationary contact pieces are disposed in pairs adjacent to each other, so that a plurality of contact bridges are provided in one device. A further advantage is the adaptability of the movable contact pieces to the position of the stationary contact pieces. In addition, a considerable stabilization of each movable contact piece during the switch-on process is obtained due to the considerable weight reduction of the contact bridge and by the arrangement of a separate contact spring with each contact piece. Due to known physical laws, a light body impacts upon an obstacle at a lighter impact energy than a heavy body, because of the equation:

$$E=(m\cdot v^2/2)$$

Therein, E=impact energy, m=mass of the moved body and v=speed of the moved body.

The invention has a further advantage—namely, the movement of the flexible contact bridge between the two movable contact pieces has a dampening effect on the switch-on impact of the contacts which is prevented in accordance with the invention. Since the invention, for practical purposes, contributes an impact-free contact device, the switch-on burn-off is negligibly small which, in turn, permits a reduction in size of the contact pieces or, at the same large size of the contact pieces, a substantially higher life span.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits of the invention.

BRIEF DESCRIPTION OF THE DRAWING

In the drawings, wherein similar reference characters denote similar elements throughout the several views.

DESCRIPTION OF THE PREFERRED EMBODIMENTS

Figure 1:
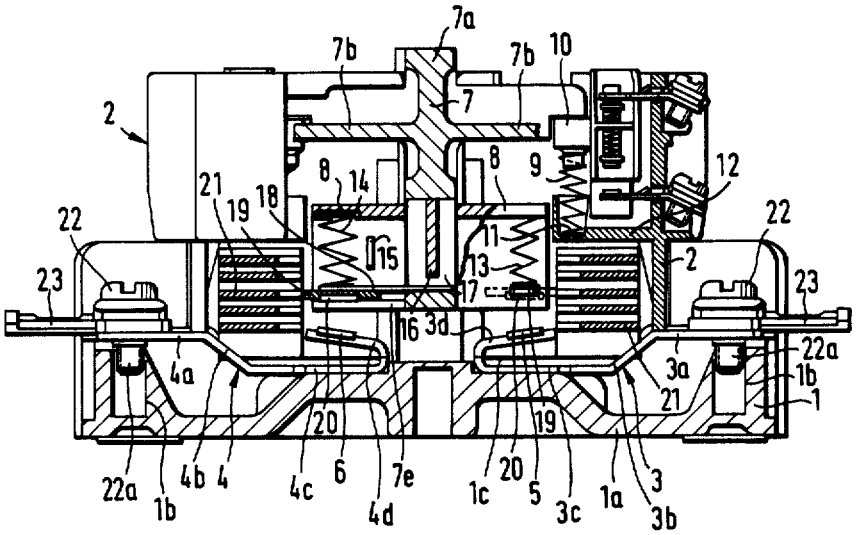
FIG. 1 is a vertical sectional view through a contact device shown in its switched-off position.
Figure 2:
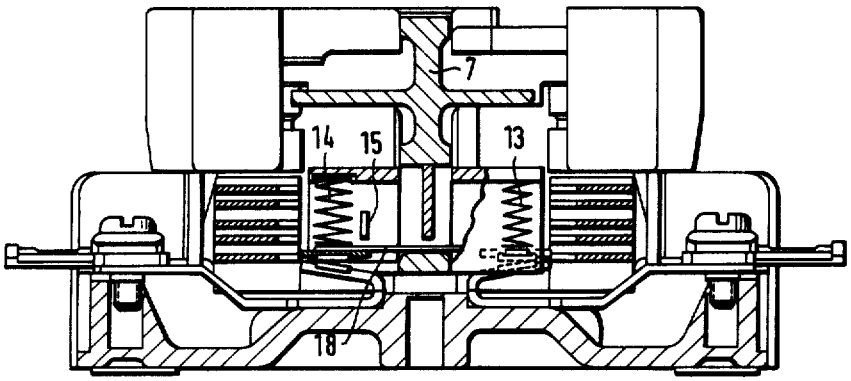
FIG. 2 is a vertical sectional view, comparable to that of FIG. 1, but showing the contact device in an intermediate switch position wherein the contact pieces just touch each other.
Figure 3:
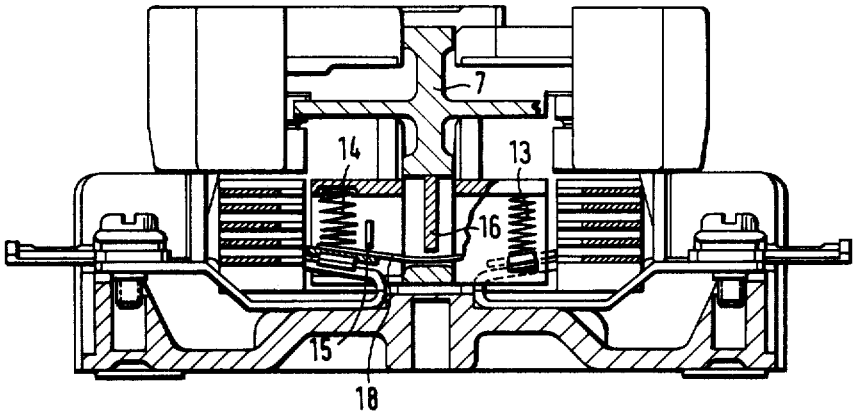
FIG. 3 is a vertical sectional view, comparable to that of FIG. 1, but showing the contact device in a switched-on position.

Referring now in detail to the drawings, FIGS. 1–3 show one embodiment of the inventive contact device in a low voltage switching device in three different switch positions. FIG. 1 shows the switch-off position. The switch device is provided with a lower housing portion 1 with a bottom 1*a* and two lateral cylindrical recesses 1*b*. The lower housing portion 1 supports an upper lid-like housing portion 2. Two contact bars 3 and 4 are mounted opposite each other at a distance from one another on raised parts of bottom 1*a*; these bars are advantageously retained by lateral guides 1*c* or groove-like recesses. These contact bars 3, 4 are provided with an outer, essentially horizontal bar portion 3*a* or 4*a*, respectively, an oblique downwardly-directed offset bar portion 3*b*, 4*b*, a subsequent horizontal bar portion 3*c*, 4*c* and finally an upwardly and outwardly bent bar portion 3*d*, 4*d*. On these latter bar portions 3*d*, 4*d*, stationary contact pieces 5, 6 are mounted. The fixed mounting of these stationary contact pieces and of the described contact bars is performed, on the one hand, by contact connecting screws 22 which, in their screwed-in position, engage with their lower screw bolt ends 22*a* into the cylindrical recesses 1*b*. By a simple mounting of the upper housing portion 2, the stationary contact bars 3,4 with the contact pieces 5, 6 are retained in their desired position. At the same time, the contact connecting screws 22 serve to mount outwardly-leading electrical connecting lines 23.

In accordance with FIG. 1, a contact bridge support 7 in correspondingly-designed lateral guides is vertically-movable in the lid-like upper housing portion 2. This contact bridge support 7 is provided at its upper end with an actuating button 7*a* which can be manually pressed downwardly for switching on the contact device, or it can be actuated by a magnet system coupled thereto (not shown) or in any other suitable mechanical manner. Lateral arms 7*b* are provided on contact bridge support 7 with outer end pieces 10 which are each engaged by the upper ends of pressure springs 9. The lower end of each pressure spring 9 is inserted into a cylindrical recess 11 of an intermediary wall 12 of upper housing portion 2. When not actuating the contact device, these pressure springs 9 act in such a manner that the contact bridge support 7 remains in the uppermost position as shown in FIG. 1. Furthermore, a double-sided horizontal arm 8 is mounted on contact bridge support 7, the underside of which supports two lateral contact pressure springs 13, 14.

A contact bridge 18 is guided through a recess 17 in contact bridge support 7, in a direction parallel with respect to the drawing plane of FIG. 1. This contact bridge 18 is also provided with contact pieces 20 at its ends. Advantageously, the two contact pieces 20 are each mounted on a contact piece support 19 which, in turn, is connected with the corresponding end of the contact bridge 18. Advantageously, the fixed connection is established, on the one hand, between contact piece supports 19 and contact pieces 20 and, on the other hand, between flexible contact bridge 18 and contact piece supports 19 by means of riveting, soldering, braze soldering, welding, dot welding, ultrasonic welding or squeezing, etc.

In accordance with the invention, contact bridge 18 is made from a flexible material and preferably from flexible wire. As flexible wire used in a flat or round flexible wire mesh is preferably used, depending on the application and the spatial conditions which prevail. Instead, the flexible contact bridge may also be constructed from a different material which is flexible in itself, for example, parallel running current-carrying leads, bands or tapes which are coupled with each other at suitable locations, for example, in the area of the contact pieces. The lower ends of the two contact pressure springs 13, 14 engage both ends of the flexible contact bridge in the area where the contact pieces or the intermediate switch contact piece supports are located. A rib 16 is provided inside recess 17 of contact bridge support 7 which runs normally with respect to the drawing plane of FIG. 1, but which affords a clearance with respect to flexible contact bridge 18. In addition, a cam rib 15 is provided in the contact bridge support 7 at both sides in close proximity to contact pressure springs 13, 14. These cam ribs are positioned in the switch-off position, in accordance with FIG. 1, at a certain distance above the flexible contact bridge 18 and, simultaneously, above movable contact pieces 20. For sake of simplicity, only one cam rib 15 is drawn on the left side of FIG. 1. However, on the other side there is also a corresponding cam rib. Finally, arc quench chambers are advantageously mounted on the outside of the described contacts which are shown in the form of arc quench chamber metal plates 21.

As shown in the embodiment of FIGS. 1 and 2, flexible contact bridge 18 is retained substantially in a straight line in contact bridge support 7. Furthermore, in this embodiment, stationary contact pieces 5, 6 are advantageously disposed in planes which run obliquely to the moving direction of movable contact pieces 20. Advantageously, the oblique position is so chosen that the contact pieces are directed in a rearwardly-ascending oblique direction. This results in the following advantages. Due to the oblique position of the stationary contact pieces and the straight or horizontal disposition of the movable contact pieces thereto when they are engaging with each other, the movable contact pieces first abut a predetermined outer edge during the switching-on process. Due to the flexible design of the contact bridge, each movable contact piece can forcibly adjust to the oblique position of the corresponding stationary contact piece. During the switching-off process, this operation takes place in a reversed sequence, i.e., at first the contact faces of the superimposed contact pieces open to the outermost edge without being lifted and without generating an arc. During the further lifting of the movable contact pieces, the contact then opens on the outer edge and an arc is generated.

Preferably, the contact piece supports of the stationary and movable contact pieces are provided with massive arcing horns or arc discharge horns in the discharge area of the arc. Since the arc is only generated on the outermost predetermined edge of the contact pieces, it is driven by the magnetic power lines of the stationary contact bars and the arc quench sheet metal plates directly from the predetermined burn-off range of the contact pieces onto the arc discharge horns from where the arc again tears off at the outer edge and only causes a burn-off at this point. In this context, it is advantageous that the arc discharge horns are provided on the same plane as the contact pieces and are tightly connected thereto. In this manner, a sufficient transfer of the arc from the burn-off area of the contact pieces to the arc discharge horns is obtained, because the arc does not have to overcome any steps and therefore does not leave any burn-off tracks at the burn-off range of the contact pieces; in other words, it is directly deflected onto the arc discharge horns.

Due to the adaptability of the movable contact pieces to the disposition of the stationary contact faces, which is made possible with the flexible connection between the two movable contact pieces with the assistance of the flexible contact bridge, the distance of the arc discharge horns changes in a favorable manner, i.e., a very small distance is created during opening and therefore a favorable take over of the arc. Therefore, in addition to the aforementioned low switch-on burn-off, there is also the aforementioned low switch-off burn-off which causes a reduction of the burn-off volume and, simultaneously, an increase in the electrical life span of the contact device.

Therefore, in addition to the aforementioned explained favorable switch-on impact conduct, there is also a low burn-off volume and, simultaneously, an increase of the electrical life span of the contact device.

The thermal stresses on the contact pieces is also low, due to the invention. The predetermined outline edge of the arc in the burn-off area of the contact pieces assures that the remainder of the contact face remains free from contamination, burn-off scratches and soot, which means that the contact faces of the contact pieces always remain clean in the switched-on position, so that the contact occurs on a clean contact face between the contact pieces. This results in a considerable advantage with respect to the contact transfer resistance and the resulting thermal stress with a permanent or continuous electric current. Furthermore, during each switching operation, a relative movement of the contact pieces toward each other occurs, so that a certain self-cleaning of the corresponding contact faces is additionally assured.

The invention provides considerable advantages with respect to electrical switch-on weld safety. The greatly increased electrical weld safety during switch-on, in comparison to the state of the art, is the result of the impact-free behavior of the movable contact pieces and from the oblique position of the stationary contact pieces, as well as the adaptability of the movable contact pieces relative to the stationary contact pieces. If, for example, a contact is loaded beyond the limit of its switch-on weld resistance, it is more or less rigidly welded. This fusing occurs only at the first contact point at the outer edge, due to the oblique position of the stationary pieces. When, at this point, the corresponding contact piece is moved further in the switch-on direction, it turns or it pivots around the fused edge up to the advanced oblique position of the stationary contact piece which is made possible due to the flexible design of the contact bridge. Due to this turn or pivot movement, the fusing is again broken. The force required therefor, is supplied by the corresponding contact pressure spring.

In this context, a further advantageous embodiment of the invention is made possible—namely, in that contact pressure springs 13, 14 are preferably disposed at an acute angle with respect to the moving direction of the movable contact pieces in contact bridge support 18. By a corresponding oblique positioning of the contact pressure springs, the force for breaking the fusing may be increased.

In a further advantageous embodiment of the invention, cam ribs 15 are disposed in contact bridge support 7 in such a manner that the movable contact pieces 20 are forcibly pivoted into the oblique position corresponding to the position of the stationary contact pieces. In this manner, the breaking-off of the fusing is also enhanced in in that the cam rib during the switch-on process pushes the fused movable contact piece, together with an arc discharge horn, forcibly into the oblique position corresponding to the stationary contact piece, so that even a stronger fusing can be released even during the switch-on process. This is particularly advantageous when using condenser contactors.

Finally, in a further advantageous embodiment of the invention, the contact pieces and/or the arc discharge horns consist of different burn-off materials on their surfaces in such a manner that a material with a high thermal load or carrying capacity is chosen in the area of the arc outline edge and, in the remainder, a material with a good electrical conductivity and lower current passage resistance. In this manner, the thermal capacity of the contact device can be further increased.

FIGS. 2 and 3 which substantially conform to FIG. 1, show a different switch position with respect to FIG. 1. In FIG. 2, the contact bridge support 7 is displaced against the force of the springs 9 downwardly in such a manner that the still horizontally-held movable contact pieces impact with their outer edges against the stationary oblique contact pieces. Flexible contact bridge 18 is bent downwardly by rib 16 during a further pushing of the contact bridge support 7, so that the cam rib 15 engages in such a manner (as shown) that the movable contact pieces are forcibly pivoted into the oblique position, as described above. It is to be understood that, in this switch-on position, contact pressure springs 13, 14 are correspondingly compressed.

Figure 4:
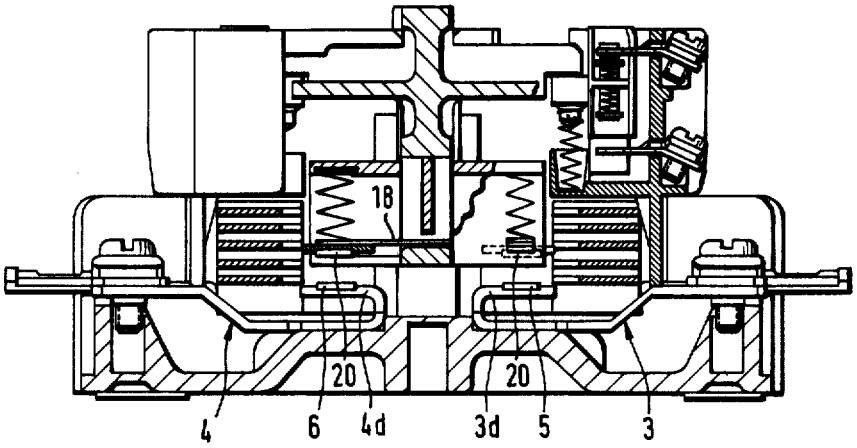
FIG. 4 is a vertical sectional view through another embodiment of the contact device shown in a switched-off position.
Figure 5:
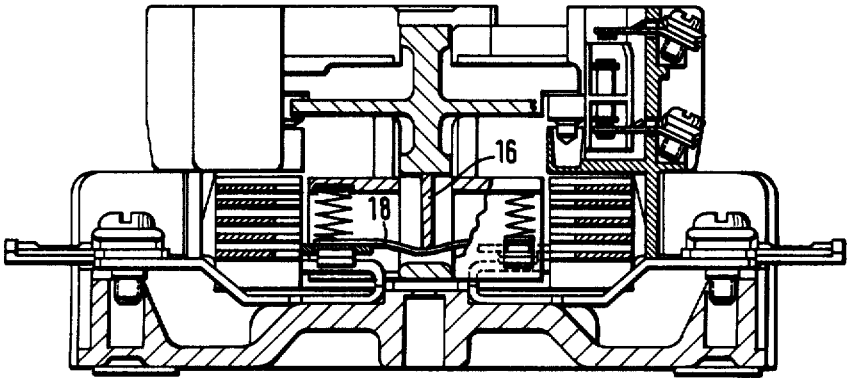
FIG. 5 is a vertical sectional view, comparable to that of FIG. 4, but showing the contact device in a switched-on position.

In accordance with a further embodiment of the invention illustrated in FIGS. 4 and 5, the stationary contact pieces 5 and 6 are disposed in planes normal with respect to the moving direction of movable contact pieces 20. Accordingly, contact bar portions **3*d*, 4*d* of contact bars 3, 4 are deflected into this horizontal plane. As can be clearly seen from FIG. 5, in this case, flexible contact bridge 18 is further bent downwardly by rib 16**, as soon as the contact pieces meet each other. This also results in advantageous moving conditions.

Figure 6:
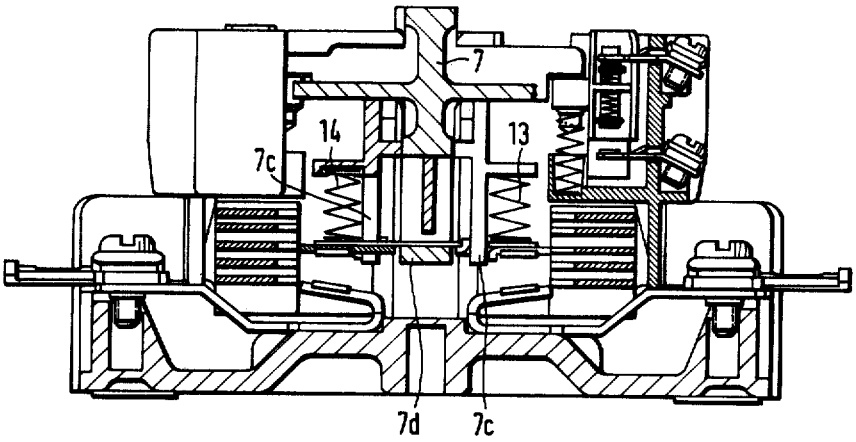
FIG. 6 is a vertical sectional view through a further embodiment of the contact device.

The embodiment of FIG. 6 substantially corresponds to the embodiments of FIGS. 1–3, however, contact bridge support 7 is designed differently, and a different support is provided. This design has the purpose of allowing the switch-off arc to discharge to all sides, since the contact pieces are freely supported. Furthermore, in this design, a positive support of the contact piece support with their associated contact pieces on the ends of the flexible contact bridge is made possible.

Furthermore, in particular embodiments and applications, it is advantageous to provide the contact piece support with the associated contact pieces in a suspended or loose manner between corresponding abutments of the contact bridge support and the contact pressure springs. For this purpose, the embodiment in accordance with FIG. 6 is suitable since the contact bridge support 7 is provided with further vertical guides *7c* on the inner side of the contact pressure springs 13, 14. These guides serve as an additional guide for guiding the flexible contact bridge between rib 16 and the lower part *7c* of the contact bridge support for the inserted flexible contact bridge.

Figure 7:
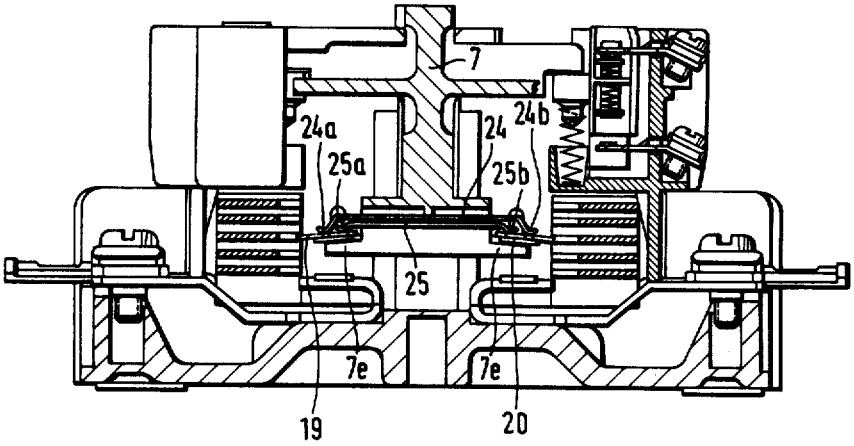
FIG. 7 is a vertical sectional view through a contact device in still another embodiment of the invention.

FIG. 7 shows a contact device which, in the principal construction, corresponds to the one of FIGS. 4 and 5. However, in this particular embodiment, the contact bridge consists of a flexible material in the form of one or a plurality of leaf springs. In the embodiment according to FIG. 7, two leaf springs 24 and 25 are serially-arranged in the direction of movement of contact bridge 7 and they are guided with free motion clearance or free play within contact bridge support 7. Each leaf spring may be very thin and preferably consists of copper-bronze or brass-bronze. When using such leaf springs, the contact pressure springs which were used as helical springs in the previous embodiments may be eliminated since the leaf springs simultaneously serve as contact pressure springs for the two movable contact pieces 20. Advantageously, the connection between the two movable contact piece supports and the ends of the two leaf spring 24, 25 is made, due to the inherent spring pressure of the leaf springs. Thereby, it is advantageous that the movable contact piece supports 19 are guided obliquely relative to the moving direction of contact bridge support 7, preferably by means of correspondingly obliquely-designed lateral shoulders or abutments 7*e*. The contact faces 24*a*, 24*b* and 25*a*, 25*b* on the ends of leaf springs 24 and 25 are advantageously covered with a good conductive, thin contact material layer. Thereby, the leaf springs are so designed that their ends provide a dot support on contact piece supports 19. Due to the dot engagement of the leaf spring end, the two contact piece supports which are very small in their mass can be very well adjusted to the stationary contact pieces during the switch-on process.

When using two leaf springs 24 and 25, they advantageously have a different length. In such a case, the two leaf springs are so designed and disposed that the spring effect during the switch-on process occurs in a timed sequence. In this manner, the switch-on forces for the contact transmission during the switch-on process are kept low. In practice, the outer longer leaf spring 24 exerts the first contact pressure until, after a defined path, the second leaf spring 25 substantially reinforces the contact pressure. The effect of the second leaf spring 15 occurs shortly before the final switch-on position, i.e., the contact receives a relatively high contact pressure for the current feeding which has a favorable effect on the contact heating. Mostly, the inventive contact devices are actuated by a magnetic drive (not shown). When using a magnetic drive, the further advantage is obtained that, due to the aforementioned position of the two leaf springs, this magnetic drive is loaded at the very last moment of the switch-on process with the force of the second leaf spring, i.e., at the moment when it has its largest pulling forces. Due to the stepwise arrangement of the contact forces, a normal magnet is required and this arrangement has a favorable effect on the wear of the magnet. The two leaf springs of the movable flexible contact bridge may be directly or tightly superimposed with respect to each other. In particular, when large switch capacities are required, it is advantageous to maintain the two leaf springs 24, 25 at a distance by means of individual extensions or corrugations or any other suitable distance spacers. Thereby, a very favorable large heat emission face is obtained, especially for a maximum, permanent or continuous current.

A further improvement of the embodiment of the contact device in accordance with FIG. 7 can be obtained in that a good current conducting flexible wire is associated with at least one leaf spring. The flexible wire may preferably be imbedded between the two leaf springs 24, 25. However, one can encompass one or both leaf springs with the flexible wire.

The contact device in accordance with FIG. 7 has a further advantage, especially for direct current switching, in that a particularly large opening path of the contact can be realized without enlarging the outer measurements of the contact device. This is mainly possible because the helical contact pressure springs of the aforementioned embodiment can be eliminated. The advantage of the large opening path of the contact can also be obtained in the subject device structure when the subject contact bridge support is replaced with a contact bridge support with the explained leaf springs, in accordance with FIG. 7. The large opening path is of substantial importance for controlling the arc, especially when using direct current.

In the aforementioned embodiments, only two stationary contact bars and one flexible contact bridge are provided. The inventive contact devices may be provided with a plurality of pairs of contact bars and flexible contact bridges mounted normally with respect to the drawing plane, for example. The same is true for arranging them in a superimposed relationship in one or more levels.

Figure 8:
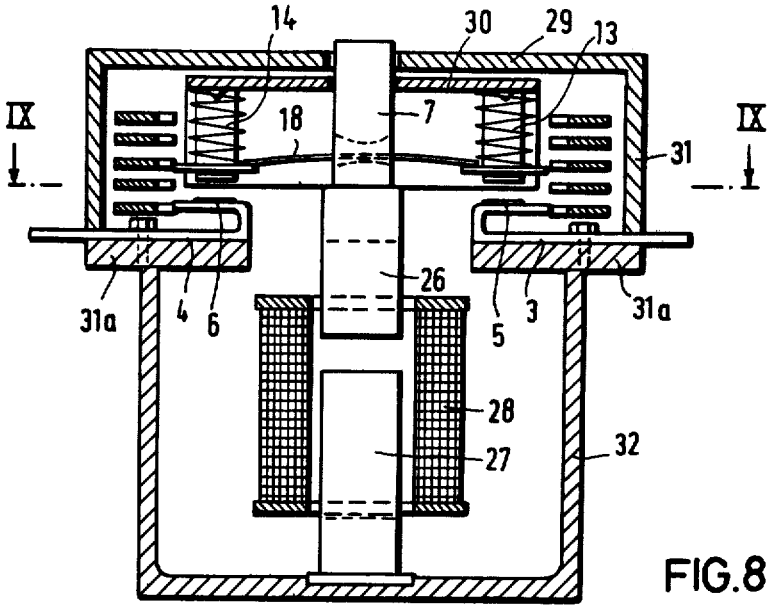
FIG. 8 is a vertical sectional view of another embodiment of the contact device with a connected magnet system.
Figure 9:
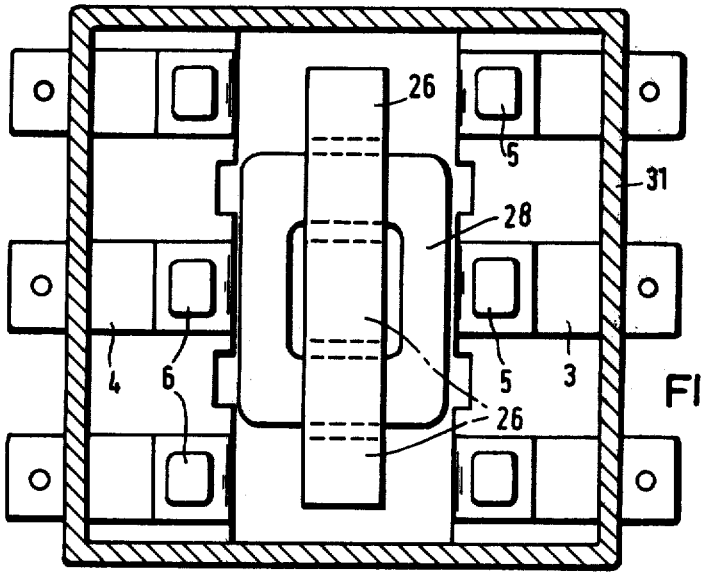
FIG. 9 is a simpified horizontal sectional view of the device shown in FIG. 8.

FIGS. 8 and 9 show a further embodiment of the invention. Here, it is shown that it is possible, due to the low weight of the flexible contact bridges 18, to make them relatively long and therefore to be able to mount the stationary contact bars 3, 4 with the associated stationary contact pieces 5, 6 at such a large distance from each other that one can remove the coil 28 of the lower housing 32, which usually is mounted on a magnet core 27, upwardly from the housing without requiring one to detach the total wiring of the contact device. Only the lid 29 of the upper housing 31 has to be removed for removing or exchanging the coil 28. Thereafter, one can remove the contact bridge support 7, together with the contact bridges 18 or the contact bridges alone, as well as the movable contact pieces which, in turn, are mounted in a frame-like unit 30, together with the connected armature 26. It is to be understood that the bottom 31*a* of the upper housing portion 31 has such a large opening that the coil 28 can be removed therethrough. Therefore, the flexible contact bridges in this total structure result in a considerable assembly simplification and a substantial simplification during repairs when the coil has to be replaced. In comparable structures, the total device had to be disassembled and, above all, the wiring leading to the outside had to be detached from the stationary contact bars.

Thus, while only several embodiments of the present invention have been shown and described, it will be obvious that many changes and modifications may be made thereunto, without departing from the spirit and scope of the invention.

What is claimed is:

1. In a contact device for low voltage switching devices of the type including a housing, at least two stationary contact bars each having a stationary contact piece, a contact bridge support disposed in the housing and at least one electrically conductive contact bridge which is disposed in the contact bridge support and is movable by means of a spring force, the improvement comprising:

said contact bridge being made of a flexible material and having two movable contact pieces arranged to impact on said stationary contact pieces, respectively, each movable contact piece having a separate contact pressure spring associated therewith disposed between said contact bridge support and said contact bridge, and exerting said spring force on said contact bridge, whereby upon said contact pieces impacting with one another the force of impact of said contact pieces and the weight of said contact device is substantially reduced compared to contact devices made of rigid material.

2. The contact device according to claim 1, further comprising at least two contact piece supports coupled to respective outer portions of said flexible contact bridge, said movable contact pieces being mounted on said contact piece supports, respectively.

3. The contact device according to claim 2, wherein said contact piece supports, said movable contact pieces, and said contact bridge are fixedly connected together near the ends of said flexible contact bridge.

4. The contact device according to claim 2, wherein said contact piece support and said movable contact pieces mounted thereon, respectively, are positively locked onto the ends of said flexible contact bridge.

5. The contact device according to claim 2, wherein said contact piece supports with the movable contact pieces mounted thereon, respectively, are each loosely retained between a separate abutment of said contact bridge support and said contact pressure springs, respectively.

6. The contact device according to claim 2, wherein said contact piece supports of said stationary and movable contact pieces further include massive arc discharge horns disposed in said housing within an arc discharge range.

7. The contact device according to claim 6, wherein each contact piece has a surface plane, and wherein said arc discharge horns are disposed in a plane close to the surface planes of said contact pieces, and are tightly coupled to said contact pieces, respectively.

8. The contact device according to claim 6, wherein at least one of said contact pieces and said arc discharge horns comprise different respective burn-off materials on their surfaces, a first material with a relatively high current passage resistance and a high thermal stressability being employed in an area defining the arc border while on the remainder thereof there is employed a material with a good electrical conductivity and lower current passage resistance than said relatively high current passage resistance.

9. The contact device according to claim 1, wherein said flexible contact bridge is retained substantially in one straight plane within said contact bridge support upon said spring force urging said contact bridge to move into said plane.

10. The contact device according to claim 1, wherein said flexible contact bridge is initially disposed in a straight plane, and is retained in an arcuate-like manner within said contact bridge support upon said spring force acting on said contact bridge approximately at right angles to said plane.

11. The contact device according to claim 1, wherein said contact bridge is initially disposed in a straight plane, and wherein said stationary contact pieces are disposed in planes normal to the moving direction of said movable contact pieces upon said spring force acting on said contact bridge approximately at right angles to said straight plane.

12. The contact device according to claim 1, wherein said stationary contact pieces are disposed in respective planes which extend obliquely with respect to the moving direction of the movable contact pieces upon said spring force acting on said contact bridge approximately at right angles to the plane thereof.

13. The contact device according to claim 12, wherein said stationary contact pieces are disposed in outwardly diverging planes.

14. The contact device according to claim 1, further comprising cam ribs disposed in said contact bridge support restraining said movable contact pieces so as to be forcibly pivoted into an oblique position corresponding to the position of said stationary contact pieces.

15. The contact device according to claim 1, wherein said contact bridge comprises a first leaf spring which simultaneously serves as a contact pressure spring for each of said contact pieces, said spring face acting on said contact bridge.

16. The contact device according to claim 15, wherein said leaf spring is made from a copper-bronze alloy.

17. The contact device according to claim 15, wherein said leaf spring is made from a brass-bronze alloy.

18. The contact device according to claim 15, wherein said leaf spring has contact faces at the ends thereof with said contact piece supports provided with a good conductive thin contact material layer.

19. The contact device according to claim 15, wherein said ends of said leaf spring are so designed that a point support on each contact piece support is provided.

20. The contact device according to claim 15, further comprising a second leaf spring similar to, and positioned substantially parallel to said first leaf spring, and wherein said leaf springs are serially and consecutively guided in the moving direction of said contact bridge, a play being provided between said leaf springs within the contact bridge support, said leaf springs each having different respective lengths.

21. The contact device according to claim 20, wherein said two leaf springs are so designed and positioned that, during the switch-on process, the spring effect occurs in timed sequence.

22. The contact device according to claim 20, wherein said movable contact piece supports are guided by said contact bridge support obliquely with respect to the moving direction thereof.

23. The contact device according to claim 20, wherein said two leaf springs are generally retained at a predetermined distance from each other.

24. The contact device according to claim 20, wherein an electrically-conductive flexible wire is provided for at least one of said leaf springs.

25. The contact device according to claim 24, wherein said flexible wire is positioned between said two leaf springs.

26. The contact device according to claim 24, wherein one of said leaf springs is surrounded by said flexible wire.

27. The contact device according to claim 1, wherein said housing includes a removable lid, and further comprising a magnet system including wiring supplying current thereto, a coil and an armature removably coupled to said contact bridge support for operatively exerting pressure on said contact pressure springs, and wherein said stationary contact bars which are provided with said contact pieces are disposed at such a distance spaced apart from each other, and said flexible contact bridge is so dimensioned in its length, and the housing is so designed on the inside thereof, that said coil of said magnet system is removable therefrom without detaching said wiring from said magnet system, after removing said lid, as well as after removing the contact bridges together with the contact bridge support and said armature.

28. The contact device according to claim 27, wherein said housing comprises an upper portion and a lower portion, said upper portion encompassing said total contact device and the lower portion encompassing said magnet system, said upper portion further comprising plug-in connections, said lower portion being coupled to said upper portion by said plug-in connections.

29. The contact device according to claim 1, wherein said contact bridge support includes a contact bridge area provided with two recesses near outer ends thereof, an end of each contact pressure spring operatively being nested in a respective recess.

* * * * *